US005170643A

United States Patent [19]

Porcell, Jr.

[11] Patent Number: 5,170,643

[45] Date of Patent: Dec. 15, 1992

[54] EARRING JACKET

[75] Inventor: Jose J. Porcell, Jr., La Crescenta, Calif.

[73] Assignee: Orogem Corporation, Los Angeles, Calif.

[21] Appl. No.: 829,929

[22] Filed: Feb. 3, 1992

[51] Int. Cl.[5] ..... A44C 7/00

[52] U.S. Cl. ..... 63/13; 63/12

[58] Field of Search ..... 63/12, 13, 14.1-14.8

[56] References Cited

U.S. PATENT DOCUMENTS

| | | | |
|---|---|---|---|
| 216,586 | 6/1879 | Vester | 63/12 |
| 292,810 | 2/1884 | Hartmann | 63/12 |
| 758,848 | 5/1904 | Dejchar | 63/12 |
| 3.116,616 | 6/1964 | Bangs | 63/13 |
| 4,907,424 | 3/1990 | Reinstein | 63/12 |

FOREIGN PATENT DOCUMENTS

| | | | |
|---|---|---|---|
| 574345 | 11/1923 | France | 63/12 |
| 317165 | 4/1934 | Italy | 63/13 |
| 1221 | of 1870 | United Kingdom | 63/13 |
| 759383 | 10/1956 | United Kingdom | 63/12 |
| 2216772 | 10/1989 | United Kingdom | 63/12 |

*Primary Examiner*—Renee S. Luebke
*Assistant Examiner*—F. Saether
*Attorney, Agent, or Firm*—Robert R. Thornton

[57] ABSTRACT

An earring jacket has a connecting member having a bore therethrough at one end to receive attaching means for attaching the connecting member to a human ear and an ornamental member pivotally connected to the connecting member so that the ornamental member, when so connected, pivots with respect to the connecting member about an axis transverse to the axis of said bore so that the ornamental member hangs vertically from the ear.

5 Claims, 1 Drawing Sheet

EARRING JACKET

FIELD OF THE INVENTION

The present invention relates to jewelry, and more particularly to jewelry of the earring jacket type designed to be worn from the human ear.

SUMMARY OF THE INVENTION

According to the present invention an earring jacket includes a connecting member having a bore extending therethrough, the bore having an axis and being adapted to receive attaching means for attaching the connecting member to a human earlobe against the inside portion thereof and an ornamental member, with means for pivotally connecting the ornamental member to the connecting member so that the ornamental member pivots with respect to the connecting member about an axis transverse to the axis of the connecting member bore. In the preferred embodiment, the connecting member is elongated with a width substantially greater than its thickness, and the bore is disposed at a first end thereof and the pivot means connects the ornamental member to the connecting member at a location adjacent the bottom of the earlobe so as to be remote from the bore, the pivot means including a first pivot element on the connecting member which defines the pivot axis to extend transversely of the connecting member bore axis.

BRIEF DESCRIPTION OF THE DRAWING

The invention may be more readily understood by referring to the accompanying drawing in which.

DETAILED DESCRIPTION OF THE PREFERRED EMBODIMENT

Figure 1:
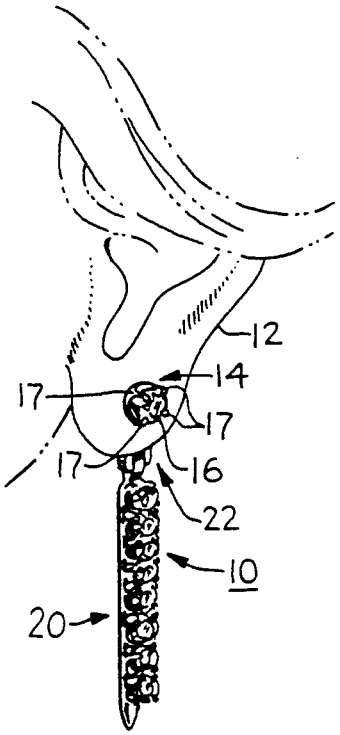
FIG. 1 is a perspective view of an earring jacket according to the present invention being worn by a user illustrating the positioning of the earring jacket at the inside portion of an earlobe.

Referring now to FIG. 1, there is shown a perspective view of an earring jacket 10, according to the present invention, attached to a human earlobe 12 by a stud 14. As will be seen in FIG. 1, the earring jacket 10 hangs vertically from the ear 12. In FIG. 1, the earring jacket 10 is illustrated as being attached to the inside of the earlobe 12 by the stud 14, which is a conventional ear stud and is comprised of a diamond 16 held by four prongs 17 which are joined together at a base (not shown) attached to a head (not shown) from which a post (not shown) extends through the earlobe 12. The earring jacket 10 is held in place against the inside of the earlobe 12 on the ear stud post by a conventional ear nut (not shown) at the other end of the post. Alternatively, as will be apparent from the description hereinafter, any other type of device which is the functional equivalent of the stud post may be utilized to hold the earring jacket 10 to the inside portion of the earlobe 12.

Figure 2:
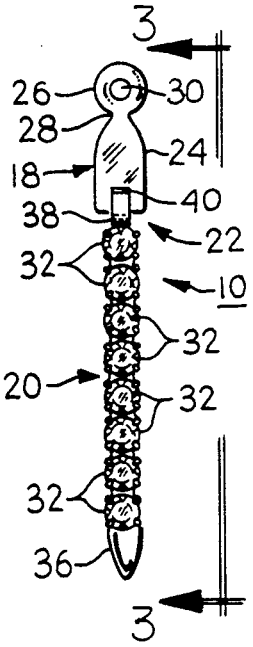
FIG. 2 is a front elevational view of the earring jacket shown in FIG. 1.

Referring now to FIG. 2, there is a shown a front elevational view of the earring jacket 10 illustrating its construction as having a connecting member 18 and an ornamental member 20 connected together at a pivot 22. The connecting member 18 in the preferred embodiment shown in FIG. 2 is of a generally keyhole shape in plan view, having a lower portion 24 adjacent the pivot 22 and an upper portion 26, the lower portion 24 and upper portion 26 being connected together at a neck 28. The upper portion 26 has a bore 30 extending therethrough through which the post referred to with respect to FIG. 1 or other connecting member extends so as to hold the earring jacket 10 against the inside of the earlobe 12. The ornamental member 20 may be of any desired configuration with respect to containing one or more diamonds or other gems 32 or may be simply an ornamental configuration of precious or shiny metal in its less expensive embodiments. The diamonds 32 are held in place by prongs 34 similar to the prongs 17 illustrated with respect to the stud 14. The ornamental member 20 terminates at its lower end in a head 36 which underlies the diamonds 32 as will become readily apparent with respect to FIG. 3. The ornamental member 20 terminates at its upper end 26 at the pivot 22 in an ornamental member pivot element 38 which is disposed in a slot 40 formed in the connecting member 18.

Figure 3:
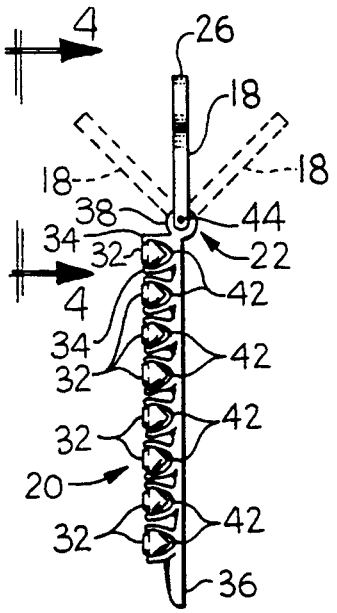
FIG. 3 is right side elevation of the earring jacket taken along lines 3—3 of FIG. 2.

Referring now to FIG. 3, there is shown a right side elevational view of the earring jacket 10 taken along line 3—3 of FIG. 2. The connecting member 18 is shown in two pivoted positions by dotted lines as well as in the position illustrated in FIG. 2. As is apparent in FIG. 3, the connecting member is relatively thin compared to its width, particularly with respect to the lower portion 24, as shown in FIG. 2. The diamonds 32 are shown in FIG. 3 to be held in position by the prongs 34 which are attached to base 42 which are connected to one another by being fixed to the head 38. The connecting member 18 includes a pivot pin 44 extending laterally across the connecting member lower portion 24 so as to pass through the ornamental member pivot element 38 as will become apparent with respect to the description of FIGS. 4 and 5 hereinafter. The pivot pin 44 permits the connecting member 18 and ornamental member 20 to pivot freely in one plane with respect to one another. The ornamental member 20 will hang vertically from inside the wearer's earlobe irrespective of the inclination of the head of the wearer or the particular physical configuration of the ear of the wearer because of the pivoting of the connecting member 18 about the bore 30 which is transverse to the axis of the pivot between the ornamental member 20 and the connecting member 18, as is apparent from FIGS. 4 and 5.

Figure 4:
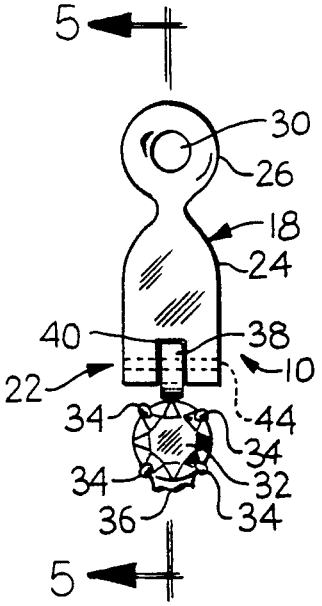
FIG. 4 is a partial plan view taken along lines 4—4 of FIG. 3 illustrating in greater detail a portion of the earring jacket.

Referring now to FIG. 4, there is shown a partial plan view of the earring jacket 10 consisting of the connecting member 18, the pivot 22 and the upper portion 26 of the ornamental member 20. The pivot pin 44 is shown in dotted lines in FIG. 4 as extending across the connecting member lower portion 24 so as to engage the ornamental member pivot element 38 which is disposed within the slot 40 of the connecting member 18. The bore 30 in the connecting member 18 is seen in FIG. 4 to extend transversely of the pivot pin 44 thereby providing a gimballing action with respect to the attachment of the ornamental member 20 to the human ear 12 so as to ensure that the ornamental member 20 hangs in a vertical position.

Figure 5:
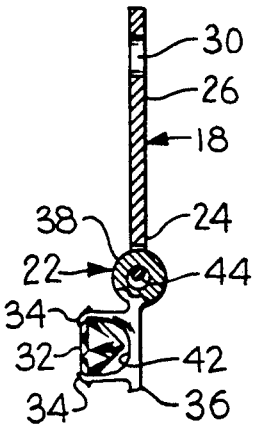
FIG. 5 is a partial sectional view of the earring jacket taken along lines 5—5 of FIG. 4.

Referring now to FIG. 5, the bore 30 in the connecting member upper section 26 is also seen to extend transversely of the pivot pin 44 which extends through the ornamental member pivot element 38, shown in FIG. 5 as of ring or disk-like configuration and attached to the head 36 just above the first one of the diamonds 32 closest to the pivot 22.

In the particular embodiment illustrated in the drawing a pivot pin is held by the connecting member and extends through a slot formed therein so as to engage a ring formed on the ornamental member. However, this construction could be reversed, that is, the ornamental member could have a slot formed therein through which a pivot pin extends and the connecting member have a pivot element extending from the lower portion 24.

The earring jacket 10 illustrated in the drawing is comprised of the connecting member 18 and the ornamental member 20. The ornamental member 20 shown in the drawing is of comparatively simple configuration, consisting of a single line of diamonds. More elaborate diamond configurations, or mixtures of diamonds, other precious gems or non-precious stones may be used in the present invention, which is not limited to a single linear array of stones. For example, a triangular array of stones could be used in the ornamental member 20, or the ornamental member 20 could consist of a triangular member only two, one or no arm of which carried stones, or a circle or other shape. Obviously, many other variations for the ornamental member are readily apparent which may be used with the connecting member 18 and the pivot 22 arranged so that the pivot pin 42 is transverse to the bore 30 in the connecting member within the practice of the present invention.

The invention claimed is:

1. An earring jacket for attachment to a human earlobe by being mounted on a post which extends through the earlobe from an ear stud disposed at the outside of the earlobe, comprising:

a connecting member having an elongated main body portion terminating at one end in an upper body portion having a bore formed about an axis so as to extend through the upper body portion for receiving said stud post in a pivotal engagement, whereby the connecting member may pivot with respect to the stud post about the axis of the bore when held adjacent the earlobe by an ear nut mounted on the stud post;

an ornamental member;

a pivot pin having a longitudinal axis; and means for connecting said ornamental member to said connecting member remote from said connecting member upper body portion by means of said pivot pin and for holding said pivot pin fixed in position with respect to the connecting member so that the pivot pin longitudinal axis is perpendicular to and remote from the upper body portion bore axis, whereby relative movement between the ornamental member and the connecting member is limited to arcuate movement about the longitudinal axis of the pivot pin.

2. An earring jacket according to claim 1, and in which the connecting means includes pivot bore means formed in said connecting means includes pivot bore means formed in said connecting member in a lower body portion thereof through which said pivot pin extends, said pivot bore means being operable to hold said pivot pin in the disposition in which the pivot pin longitudinal axis is perpendicular to the connecting member upper body portion bore axis.

3. An earring jacket for attachment to a human ear at the inside of the earlobe portion thereof by connection to an ear stud in which a stud main body portion is disposed on the outside portion of the earlobe and a stud post extends from the main body portion so as to be engageable with the earring jacket when the earring jacket is disposed adjacent the inside portion of the earlobe, comprising:

a connecting member having an elongated main body portion including of a pair of oppositely-disposed, coextensive, generally flat parallel faces, the distance between which defines the thickness of the connecting member, said body portion faces each having a width greater than said thickness and a length substantially greater than said width, said parallel faces of said main body portion terminating at one end in an upper body portion;

means for attaching the connecting member to the post at the inside of the earlobe so as to permit the connecting member to pivot relative to the earlobe and stud main body portion in a plane parallel to the parallel faces, said attaching means including a bore formed in said upper body portion for receiving said post, said bore having a bore axis which is perpendicular to the connecting member parallel faces;

an ornamental member;

a pivot pin having a longitudinal axis; and means for connecting said ornamental member to said connecting member remote from said connecting member upper body portion by means of said pivot pin and for holding said pivot pin fixed in position with respect to the connecting member so that the pivot pin axis is perpendicular to and remote from the upper body portion bore axis, whereby relative movement between the ornamental member and the connecting member is limited to arcuate movement about the longitudinal axis of the pivot pin.

4. An earring jacket for attachment to a human ear at the inside of the earlobe portion thereof, comprising:

a connecting member having an elongated generally flat main body portion with a pair of oppositely disposed coextensive generally flat parallel faces, the distance between which defines the thickness of the connecting member, said body portion faces each having a width greater than said thickness and a length substantially greater than said width, said main body portion parallel faces terminating at one end in an upper body portion;

means for mounting the connecting member at the inside of the earlobe in conjunction with an ear stud with a stud main body portion positioned on the outside of the earlobe and a stud post extending therefrom through the earlobe and terminating beyond the inside portion of the earlobe and on which the connecting member is to be mounted so as to be separated from said main body portion by the earlobe, whereby the connecting member may pivot about said post with respect to said earlobe and stud main body portion, said mounting means including a bore formed in said connecting member upper body portion for receiving said post, said bore having an axis which is perpendicular to the connecting member parallel faces;

an ornamental member;

a pivot pin having a longitudinal axis; and means for connecting said ornamental member to said connecting member remote from said connecting member upper body portion by means of said pivot pin and for holding said pivot pin fixed in position with respect to the connecting member so that the pin axis is perpendicular to and remote from the upper body portion bore axis, whereby relative movement between the ornamental member and the connecting member is limited to arcuate movement about the longitudinal axis of the pivot pin.

5. An earring jacket according to either of claims 3 or 4, and in which the connecting means includes pivot bore means formed in said connecting member in a lower body portion thereof between the parallel faces so as to hold said pivot pin in the disposition in which the pivot pin longitudinal axis is perpendicular to the connecting member upper body portion bore axis.

* * * * *